US005143171A

United States Patent [19]

Glynn et al.

[11] Patent Number: 5,143,171

[45] Date of Patent: Sep. 1, 1992

[54] ROOF LIFELINE SAFETY SYSTEM AND ANCHOR ASSEMBLY THEREFOR

[75] Inventors: William Glynn, West Suffield; John Rexroad, Lyme; David S. Denny, Middle Haddam, all of Conn.

[73] Assignee: SINCO Incorporated, East Hampton, Conn.

[21] Appl. No.: 650,937

[22] Filed: Feb. 5, 1991

Related U.S. Application Data

[63] Continuation-in-part of Ser. No. 586,895, Sep. 24, 1990, Pat. No. 5,054,576.

[51] Int. Cl.[5] ..... A62B 35/00

[52] U.S. Cl. ..... 182/3; 248/237; 52/27; 182/45

[58] Field of Search ..... 182/3-7, 182/45, 231; 248/237; 52/27

[56] References Cited

U.S. PATENT DOCUMENTS

| | | | |
|---|---|---|---|
| 863,173 | 8/1907 | Haskell | 248/237 |
| 2,336,144 | 12/1943 | Wickstrom | 248/237 |
| 2,575,254 | 11/1951 | Blaugrund | 248/237 |
| 3,408,780 | 11/1968 | Brister | 248/237 |
| 4,226,058 | 10/1980 | Riley | 52/27 |
| 4,606,430 | 8/1986 | Roby | 182/3 |
| 4,942,943 | 7/1990 | Flaherty | 182/5 |
| 5,054,576 | 10/1991 | Glynn | 182/3 |

*Primary Examiner*—Reinaldo P. Machado
*Attorney, Agent, or Firm*—Chilton, Alix & Van Kirk

[57] ABSTRACT

A lifeline safety system for a pitched roof employs a frame for mounting a lifeline system above the peak of the roof. Shoulders extend from the frame and engage opposing sides of the roof. An anchor comprising a generally J-shaped bolt secures the bracket assembly to the roof. The bolt has a hook which engages the underside of the rafter. A nut has a pair of arms for torquing the nut to the bolt. In one embodiment, two roof mounting pods are pivotally mounted to a shoe which receives a retractable lifeline housing.

33 Claims, 10 Drawing Sheets

ROOF LIFELINE SAFETY SYSTEM AND ANCHOR ASSEMBLY THEREFOR

CROSS-REFERENCE TO RELATED APPLICATION

This application is a continuation-in-part of U.S. application Ser. No. 586,895 filed on Sep. 24, 1990 now U.S. Pat. No. 5,054,576.

BACKGROUND OF THE INVENTION

This invention relates generally to safety systems and devices for ensuring the safety of workers while positioned on a roof. More particularly, the present invention relates generally to safety systems and devices for preventing roofers, construction workers or the like from accidentally falling from a pitched roof.

A number of devices have been employed to prevent roofers, construction workers and other individuals from accidentally falling off roofs during construction, maintenance or other activities. Pitched roofs which have significant pitched portions or severe pitch angles may pose very hazardous risks to the safety of a worker. The danger potential associated with a pitched roof working environment has become widely recognized, and there has been an increased regulatory focus on ensuring safety for pitched roof structures.

Lifelines which may be retractable and various safety rails have conventionally been employed as safety devices in connection with the construction and maintenance of pitched roofs. In conventional safety systems, the lifelines are rigidly anchored to a fixed structure and connect with a safety belt worn by the worker. The extendable length of the lifeline is effectively restricted so that an accidental fall or rapid change of position of the worker is prevented by automatic locking of the position of the lifeline or the position of an auxiliary lifeline carried by a principal safety cable. One of the critical problems which is encountered in connection with such safety systems is anchoring the safety device to the roof structure so that the safety device remains anchored should it be subject to severe loading due to an accidental fall or usage in an emergency situation.

SUMMARY OF THE INVENTION

Briefly stated, the invention in a preferred form is a safety system which is especially adaptable for use in connection with a pitched roof. The system employs a lifeline which is receivable in a casing and is extendable and retractable so as to provide a variable length from an anchoring position as the requirements of a given job may dictate. The lifeline may be a self-contained centrifugal locking/rewinding system which employs a stainless steel cable. The lifeline is mounted in an upright bracket assembly for disposition generally above at the peak of the roof. The lifeline housing is secured to the bracket assembly.

A frame or shoe receives the lifeline housing s that the line outlet from the housing is oriented upwardly from the roof peak. Shoulders extend from the frame and are oriented for surface-to-surface engagement on opposing sides of the pitched roof. Anchors are inserted through openings of the shoulders and are secured to the roof for anchoring the bracket assembly and hence the lifeline to the roof. A spring is mounted proximate the output portion of the housing surrounding the proximal portions of the extendable lifeline so as to ensure that the lifeline is spaced above the roof. A loop or carabiner at the end of the lifeline attaches to a safety belt worn by the worker.

An anchor bolt for securing the bracket assembly to the roof comprises a generally J-shaped member comprising an elongated shank having a threaded surface and a hook which engages the underside of a roof rafter. A plate having an opening is mounted to the shank by inserting the shank through the opening. A nut is threadably engageable with the threaded surface of the shank for longitudinal displacement therealong upon application of a torque to the nut. The underside of the nut is engageable against the top of the plate. The nut comprises a pair of arms extending generally transversely thereto for torquing the nut. The upper portion of the anchor terminates in an eye. Various cables and lifelines may be connected through the eye.

The anchor is dimensioned so that it may be mounted in place by inserting the distal hook portion through an opening in the roof and positioning the hook portion of the anchor so as to engage the underside of the roof rafter. The plate engages the exterior roof and the nut is tightened against the plate to thereby securely anchor the anchor bolt to the roof.

In another embodiment a pair of pods are pivotally mounted to a shoe which receives the lifeline housing. The pods each have a pair of legs which connect at an oblique angle with a plate. The plates are pivotal for engagement against opposing sides of the pitched roof at a variety angles. The plates also include openings for receiving anchor bolt assemblies to anchor the plates to the roof. The openings function as carrier slots and the plates are pivotal to a mutually engaged position wherein the slots align to permit transport of the bracket assembly.

A support bracket may also be mounted to the lifeline housing to mount a coil spring adjacent the housing outlet for the lifeline cable. A plug is disposed at the interior of the spring. The lifeline cable traverses through a bore and the plug and axially through the coil spring.

An anchor assembly for anchoring the bracket plates to the roof may employ a plate having an aperture which is received by the J-bolt shank. The plate also has a pair of upturned flanges and an anchoring loop disposed between the flanges to provide an anchor point. A lug having a bore may also be employed to provide the anchor point. Swivel connectors may connect at the anchor point for anchoring a safety rope. The hook portion of the J-bolt may also be tapered to facilitate manipulation of the hook for attaching the hook portion to the beam. A cap and an indicator pin which aligns with the hook portion may be located at the top of the shank. A weighted wing nut and a washer having a collar for seating in a plate opening is captured on the J-bolt shank. A second retainer plate including a tang and a wing which forms an aperture may also be mounted to the J-bolt shank for clamping the J-bolt to the top and bottom portions of a beam during initial construction stages of the roof. The wing aperture may thus provide a secure tie-off point.

In another embodiment, a base is adapted to connect with four cantilever arms which are anchored by counter weights. The base receives an upwardly disposed shoe for mounting a retractable lifeline.

An object of the invention is to provide a new and improved safety system which is adaptable for a pitched roof to protect workers from falling.

Another object of the invention is to provide a new and improved anchor assembly of efficient construction for anchoring a safety system to a roof in a safe and reliable manner.

A further object of the invention is to provide a new and improved means for mounting a retractable lifeline employing a centrifugal locking/rewinding system in a secure fixed position on a roof.

Other objectives and advantages of the invention will become apparent from the drawings and the specification.

DETAILED DESCRIPTION OF THE PREFERRED EMBODIMENT

Figure 2:
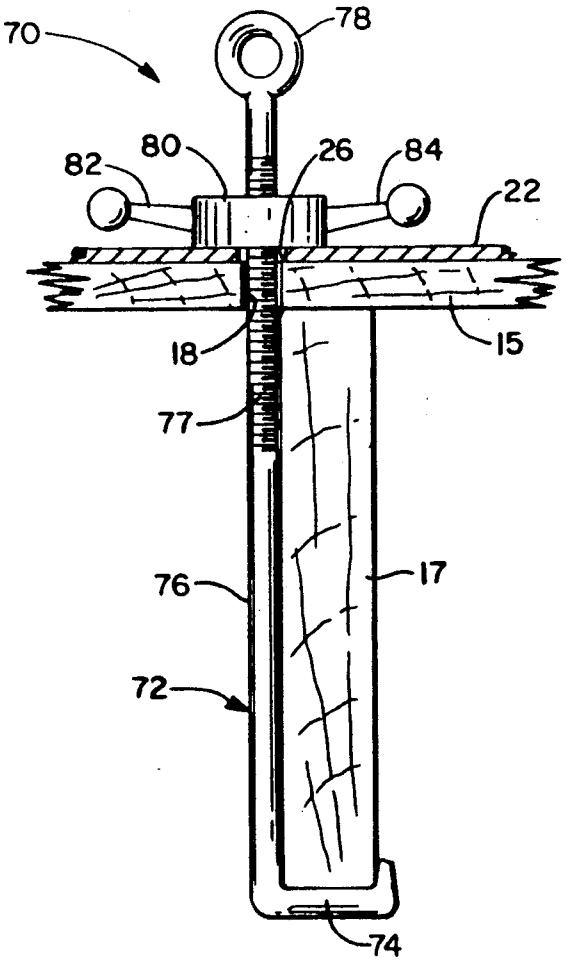
FIG. 2 is an enlarged sectional view of an anchor of FIG. 1 and a portion of the pitched roof illustrating the mounted configuration of the anchor.

With reference to the drawings wherein like numerals represent like parts throughout the several figures, a lifeline safety system in accordance with the present invention is generally designated by the numeral 10. The safety system 10 is generally adapted to provide a lifeline for an individual working on a pitched roof 12 having a peak 14. The illustrated pitched roof 12 is intended to be illustrative of a preferred environment for the invention and is not a limitation of the applicability of the invention. The worker preferably wears a safety belt or harness (not illustrated) which connects with the lifeline.

The safety system 10 comprises a mounting bracket assembly 20 which is supported by a pair of generally rectangular base plates 22 and 24. The base plates are disposed at an angle which is preferably substantially equal to the angle of the intersection at the peak of the pitched portions of the roof. The base plates may be connected by a hinge 28 so that the angle may be varied to accommodate a given roof pitch. Each of the base plates 22 and 24 engage opposing pitched portions of the roof in generally surface-to-surface contact. Each base plate has an opening 26 (FIG. 2) for receiving an anchor as detailed below.

A box-like frame 30 extends vertically upwardly from the base plates and is generally symmetric to a vertical plane through the intersection of the base plates. The frame 30 includes opposing front and rear panels 32 and 34 and substantially identical end panels 36. Openings may be formed in the panels to allow for water drainage. The panels extend vertically and cooperate to form an enclosure having a rectangular open end 38 at the top thereof. The front panel 32 may be hinged to the base plate 22 for a bracket assembly embodiment which accommodates various pitch angles. For a fixed pitch embodiment, the panels are joined along their bottom edge portions to the base plates and are configured to accommodate the pitched orientation of the base plates. In some embodiments, the frame 30 may be rotated 90° relative to the base plates in comparison to the orientation illustrated in the drawings.

The frame opening 38 and the frame plates are dimensioned to closely receive the casing or housing for a retractable lifeline system 50. Lifeline system 50 may be a conventional lifeline such as the SINCO Model 64 Retract-A-Matic TM lifeline marketed by the assignee of the present invention. The lifeline system includes a steel housing 52 which houses a self-contained 3/16 inch steel cable 54. The cable terminates with a carabiner 56 for connecting the cable with a safety belt or harness. The cable 54 or lifeline is wound on a reel within the housing and is extendable and retractable to provide a limited length as required for working on the roof. A centrifugal locking/rewinding assembly automatically prevents accidental falls by locking the cable at an attained length upon rapid acceleration tending to unwind (lengthen) the lifeline cable.

Figure 1:
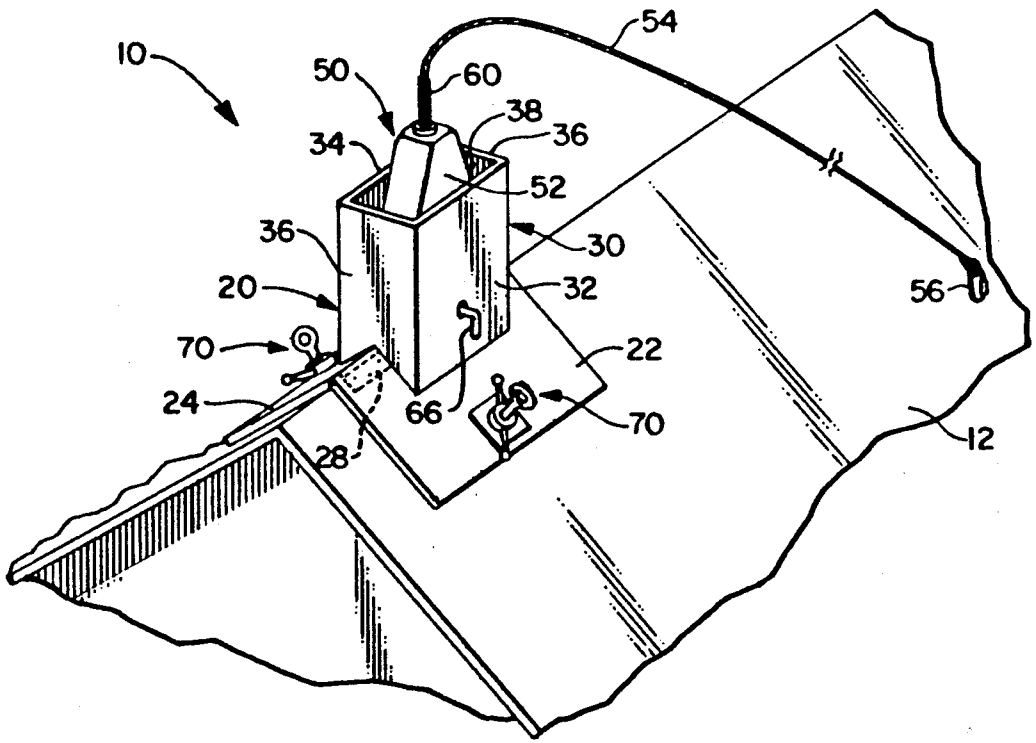
FIG. 1 is a perspective view of the roof lifeline safety system and two anchors therefor in accordance with the present invention, said system being illustrated in conjunction with a pitched roof.
Figure 3:
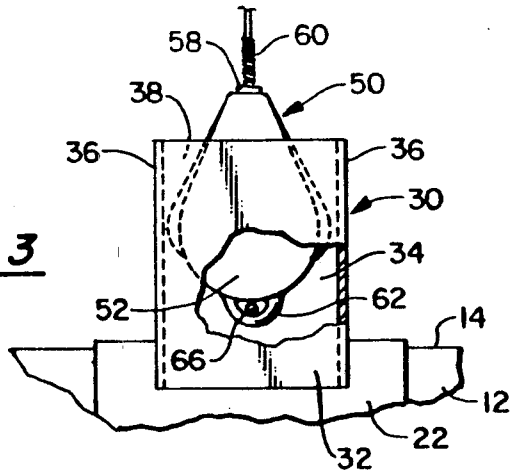
FIG. 3 is an enlarged fragmentary side elevational view, partly broken away, of the lifeline safety system of FIG. 1.
Figure 4:
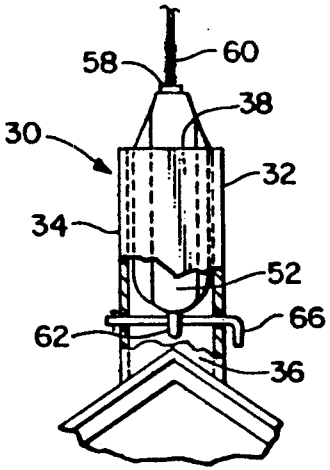
FIG. 4 is an enlarged fragmentary end view, partly broken away and partly in section, of the lifeline safety system of FIG. 1.

The lifeline cable projects through a grommet-like outlet 58 in the housing. A grommet having an inside diameter 0.05 inches greater than the diameter of the cable of 0.05 greater than the outside diameter of the spring 60 may be employed. A coiled spring 60, which extends generally vertically approximately 6 inches, at the lower end mounts at the outlet. The spring 60 surrounds the proximal portion of the lifeline cable which is disposed exteriorly from the housing 52. The housing integrally forms an eye 62 (FIG. 3) at a position (bottom in FIG. 1) generally diametrically opposite the outlet 58 to facilitate mounting or anchoring the lifeline assembly.

A pin 66 is inserted through opposed aligned openings of the frame panels 32 and 34 and the eye 62 of the lifeline assembly to secure the lifeline assembly to the bracket assembly. Other means of securing the lifeline assembly to the frame may also be employed. The lifeline assembly is uprightly oriented and constrained by the frame so that the outlet 58 for the lifeline cable is oriented generally vertically at the top of the housing. The coil spring 60 extends in a generally upward orientation to bias proximal portions of the lifeline to a position vertically positioned above the outlet. The spring 60 thus functions to prevent the lifeline cable 54 from contacting the roof when properly coupled to the safety belt or harness worn by the worker. The spring 60 also prevents the cable from kinking by controllably flexing downwardly to prevent a severe angular bend in the cable.

The bracket assembly 20 is secured to the roof at locations on opposite sides of the peak by means of a pair of anchor assemblies designated generally by the numeral 70. With additional reference to FIGS. 2 and 5, each anchor assembly 70 comprises a generally J-shaped anchor bolt 72 which is inserted through an opening 26 in the base plates and through an opening or bore 18 drilled in the roof. A wing nut 80 threaded to the anchor bolt 72 is torqued against the base plate to securely anchor the bracket assembly to the roof.

With additional reference to FIG. 2, the anchor assembly 70 comprises a generally J-shaped anchor 72 bolt manufactured of steel or other rugged high-strength material. The anchor bolt 72 is configured to include a lower hook 74, an intermediate longitudinally extending shank 76 and an integral upper eye or connecting ring 78. The diameter of the connecting ring opening may be 2¾ inches to 3 inches so the ring will accept safety snap hooks having anti-rollout features. A threaded surface 77 is formed on the shank. The nut 80 has an interior threaded surface which complements the threaded surface of the bolt. A pair of wing arms 82 and 84 project generally transversely from the body portion of the nut to facilitate manually applying a torque to the nut. In a conventional fashion, the nut is positionable along the shank by manually grasping the wing arms 82 and 84 of the nut to torque the nut to the desired position.

With reference to FIG. 2, the anchor assembly is mounted in position by drilling an opening or bore 18 through the roof substrate 15 in close proximity to a support rafter 17. The bolt 72 is dimensioned for engagement with a rafter which conventionally is either 2 inch × 8 inch or a 2 inch × 10 inch wood beam (prior to milling) although the anchor may be applicable and accordingly dimensioned to accommodate other support structure types and dimensions. The anchor bolt 72 is inserted through the base plate opening 26 and the roof opening 18 and is rotated and positioned so that the hook 74 engages the underside of the rafter 17 and catches the opposing lower side. The hook 74 preferably has square corners to closely conform to the engaged portions of the rafter. The wing nut 80 is then torqued against the base plate 22 to thereby anchor the base plate to the rafter and adjacent structures of the roof. The threaded surface 77 extends to a pre-established lower limit so as to provide a safety indicator. If the nut bottoms out at the lower limit, the installer will know that the bolt has not properly engaged the rafter.

Figure 5:
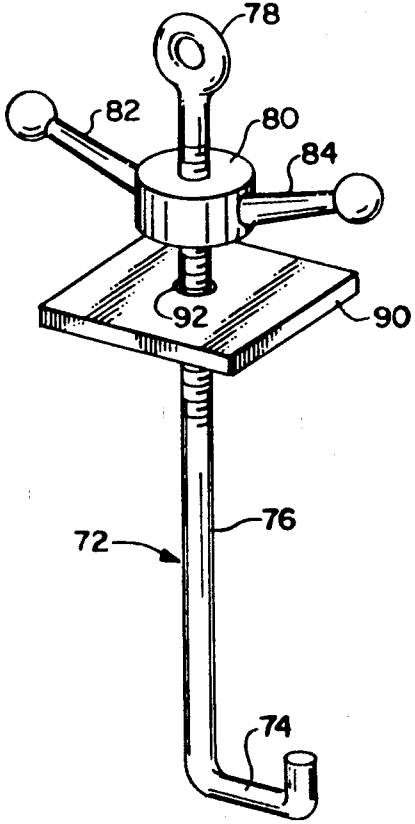
FIG. 5 is a perspective view of an anchor assembly.

With reference to FIG. 5, the anchor may also be employed with other applications. For example, the anchor assembly may be employed as an independent anchor for a cross-wire or other supporting cable (not illustrated). For such applications, a plate 90 which includes an opening 92 dimensioned to permit insertion by the anchor shaft may also be mounted to the anchor bolt. A bore is drilled in the roof adjacent the rafter 17 or other support member. The anchor bolt is then inserted through the opening and positioned as previously described for engagement by the rafter 17. The wing nut 80 is then torqued against the top of the plate 90 to provide a secure fixed mount with the roof.

The eye or connector ring 78 which preferably integrally extends from the shaft 76 may be employed for receiving a cable connector or other connector element or the cable may be inserted through the ring and secured in various manners.

Figure 7:
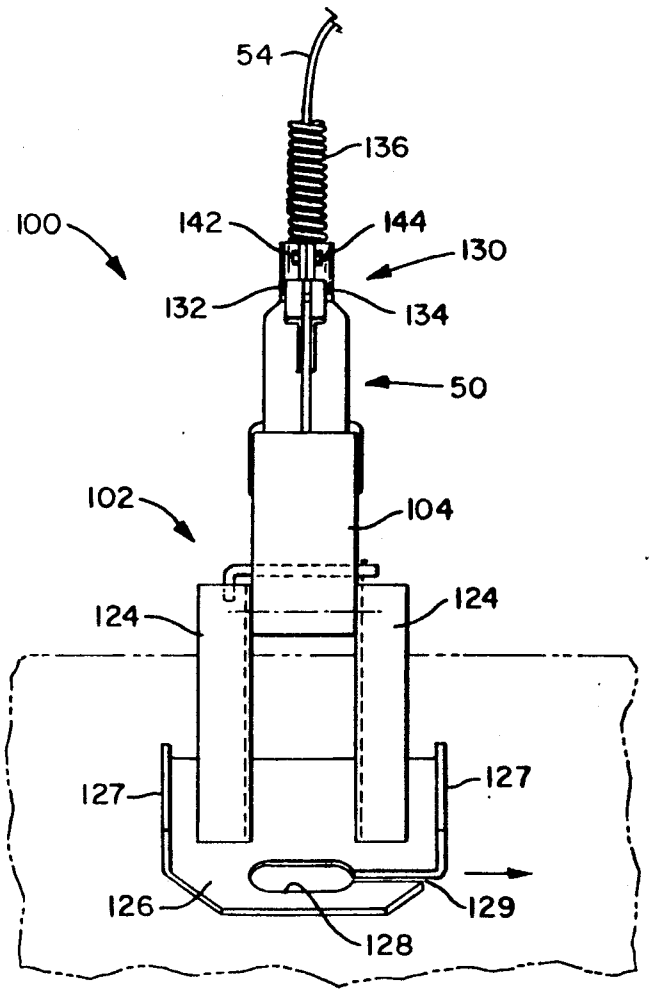
FIG. 7 is a side elevational view, partly broken away and partly in phantom, of the roof lifeline safety system and pitched roof of FIG. 6.
Figure 6:
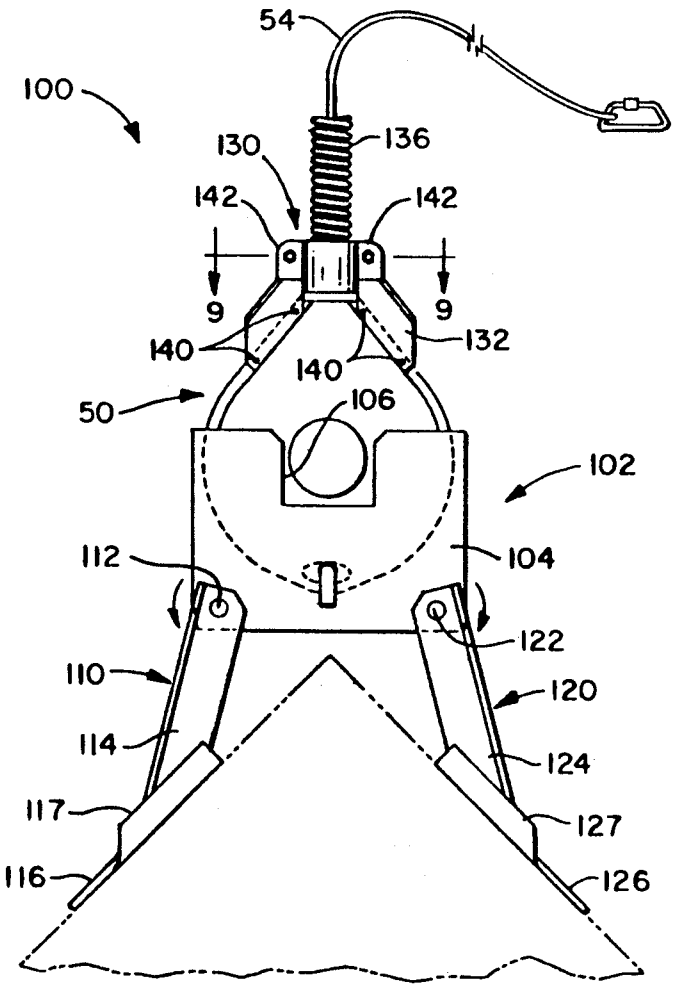
FIG. 6 is an end elevational view, partly broken away and partly in phantom, of a second embodiment of the roof lifeline safety system in accordance with the invention, said system being illustrated in conjunction with a pitched roof and in a non-anchored mode.
Figure 9:
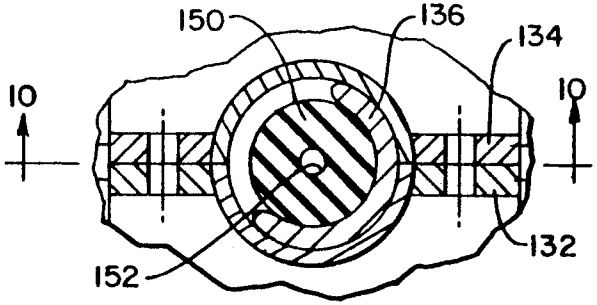
FIG. 9 is an enlarged sectional view of an upper portion the lifeline safety system of FIG. 6 taken along the line 9—9 thereof.
Figure 10:
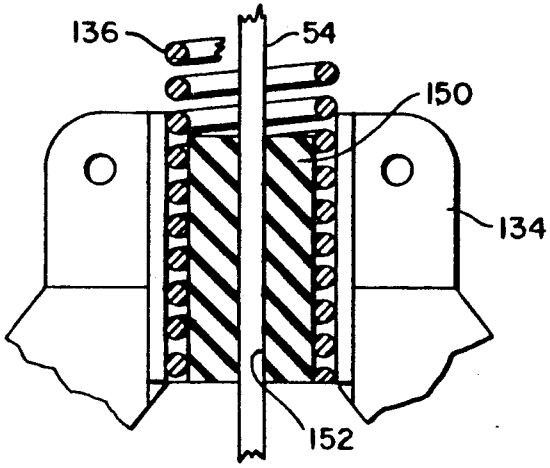
FIG. 10 is an enlarged sectional view of the lifeline safety system of FIG. 9 taken along the line 10—10 thereof.

With reference to FIGS. 6 and 7, a second embodiment of a lifeline safety system adapted for a pitched roof application is generally designated by the numeral 100. The mounted bracket assembly 102 is adapted for mounting to a pitched roof for securing a retractable lifeline system 50. The bracket assembly comprises a rectangular shoe 104 which is similar in form and function to frame 30. A pair of pods 110 and 120 are pivotally mounted to the shoe at opposed lower spaced locations by means of pivot pins 112 and 122. End panels of the shoe 104 have cutouts 106 to accommodate the protruding reel axle of the lifeline. The pivot pins 112 and 122 extend traversely through the end panels of the shoe. The pods include opposed pairs of traversely spaced legs 114 and 124 which extend from the shoe exterior. The legs 114 and 124 extend a uniform distance from the pivot axes and are respectively joined at fixed oblique angles to substantially identical support plates 116 and 126. In a preferred embodiment, the interior angles between the legs and the support plate are each approximately 30°. The support plates are adapted for engaging opposed sides of a pitched roof in generally surface-to-surface relationship. The roof anchors are not illustrated in FIGS. 6 and 7.

The support plates 116 and 126 each have an oblong slot 128 which functions as both a carrier slot for transport and an aperture for a roof anchor. A lateral access slot 129 leads from one side of the support plate to the enlarged slot 128. The slots 128 and 129 are dimensioned to receive a mounting bolt, such as anchor assembly 70 previously described or other anchor assemblies described below, for anchoring the support plates to the roof. Preferably, the anchor bolts are premounted to the roof and the entire bracket frame assembly 102 is transversely displaced in the direction of the FIG. 7 arrow until the anchor bolt is located in the slot 128. The oblong slots 128 are also dimensioned and located so that when the pods are pivoted in the direction of the arrows in FIG. 6, the plates 116 and 126 engage in generally surface-to-surface relationship, and the slots are generally alignable to provide a handle for grasping by the worker for transporting the bracket assembly to and from the work site. The shoe 104 is essentially inverted during transport. The sides of the plates 116 and 126 are bent upwardly to form flanges 117 and 127 to enhance the rigidity of the plates.

With additional reference to FIGS. 6, 7, 9 and 10, a spring mount assembly 130 comprises a pair of complementary, generally inverted, V-shaped support brackets 132 and 134 which attach to the top of the lifeline housing adjacent the outlet. The brackets 132 and 134 cooperate to form a close fitting sleeve mount for the spring 136. The brackets are joined to the lifeline housing 52 by fasteners 140. The upper portions of the brackets are clamped together and secured by bolts 142 and nuts 144. The sleeve is generally located coaxially with the outlet of the lifeline housing.

A rubber plug 150 is axially inserted through the spring for engagement at the lower spring portion against the housing around the housing outlet. The rubber plug 150 frictionally engages the interior of the spring coils and includes an axial bore 152 through which the lifeline cable passes. The plug 150 generally functions to prevent water from entering the lifeline housing and also functions to alleviate abrasive engagement between the lifeline cable 54 and the interior surfaces of the coil spring 136.

Figure 8:
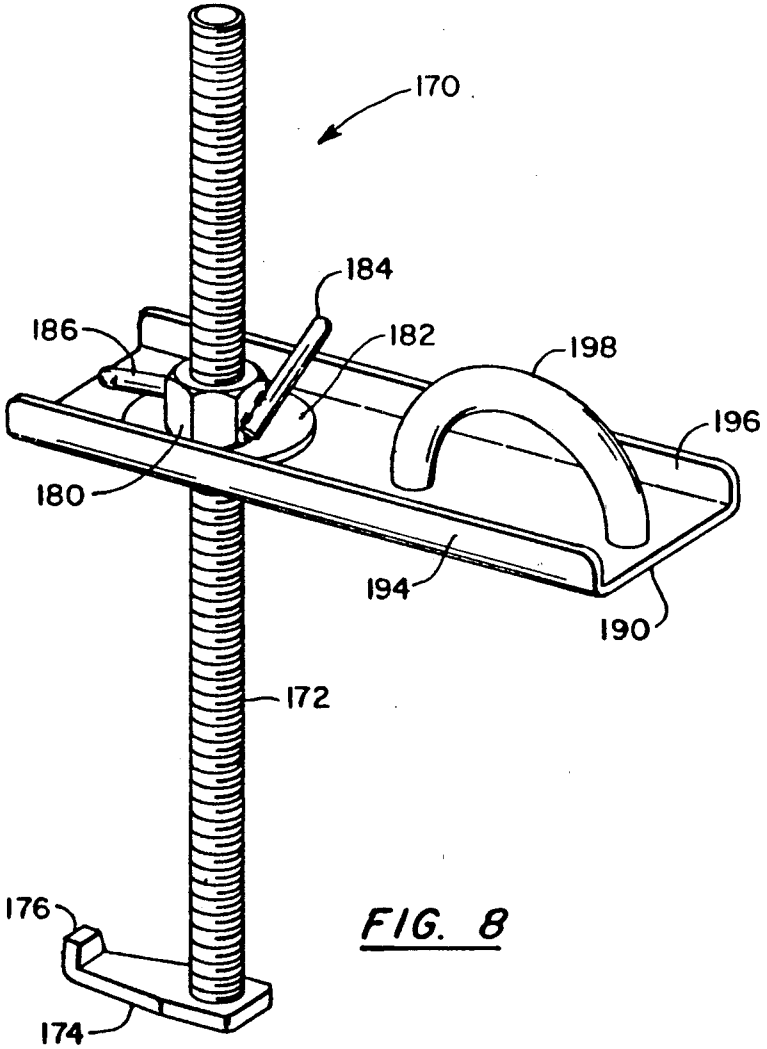
FIG. 8 is a perspective view of a second embodiment of the anchor assembly.
Figure 11:
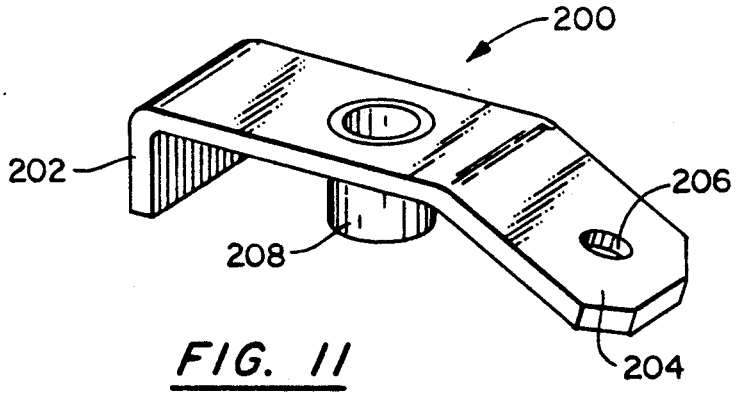
FIG. 11 is an enlarged perspective view of a clamp plate.
Figure 12:
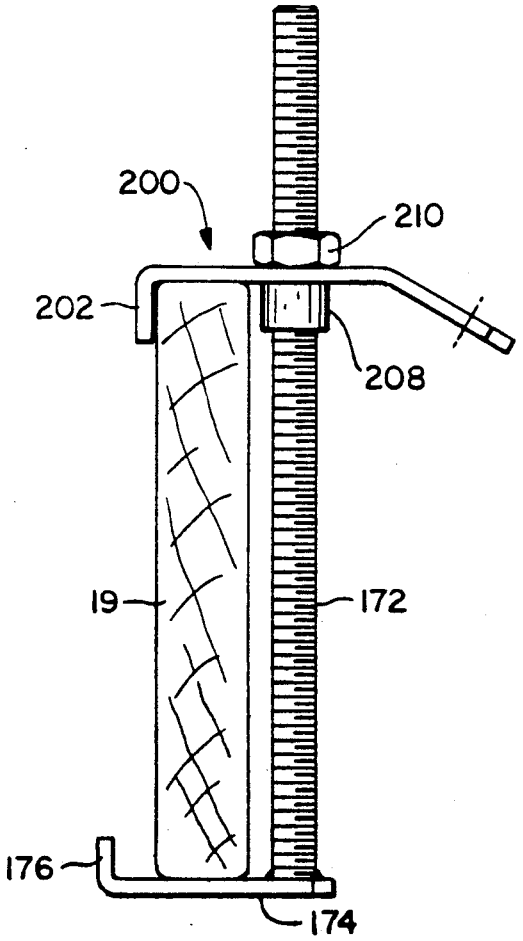
FIG. 12 is a side elevational view of a third embodiment of the anchor assembly employing the plate of FIG. 11, said anchor assembly being mounted to a beam illustrated in section.

With additional reference to FIGS. 8, 11 and 12, the lifeline safety assemblies 10 and 100 may also be anchored to the roof by means of an anchor assembly designated generally by the numeral 170. At least two anchor assemblies are required for each lifeline safety assembly. Anchor assembly 170 includes a quasi-J-shaped bolt comprising a threaded ¾ inch rod-like steel shank 172. A tapered plate 174 which may taper from approximately one inch to one half inch is welded at one end of the shank. The tapered shape facilitates manipulation during installation. The plate 174 extends to form an upturned tang 176 as previously described for J-bolt assembly 70. A wing nut 180 is threaded to the shank and is axially displaceable thereon. The hook and tang are also dimensioned to facilitate insertion of the J-bolt through the opening of the roof.

A securement plate 190 is further mounted to the shaft 170 and locked to the bolt by the nut 180 and a washer 182. The securement plate 190 is especially adapted for use with the J-bolt to secure the bracket assembly 102 to the roof but also has other applications. The securement plate 190 has an aperture dimensioned to receive the shaft 172 of the J-bolt. The aperture is symmetrically located between a pair of transversely spaced upturned side flanges 194 and 196. The flanges 194 and 196 reinforce the plate. An anchor loop 198 having a generally inverted U-shaped configuration is welded to the plate in general alignment with the aperture and midway between the flanges. The anchoring loop 198 may thus function as an anchoring point for a suspended scaffold assembly, swing stage or for other installations and applications.

The wing nut 180 has a pair of diametrically opposed wing arms 184 and 186 which extend upwardly and transversely to facilitate torquing the nut for mounting an dismounting purposes. The wing arms may constitute a pair of bent rods which are welded to the nut. The wing arms 184 and 186 are configured to accommodate the headroom constraints between the pod legs and facilitate torquing the nut upon impact by a mallet or other suitable impact tool. Alternately, nut 180 may be a commercial weighted wing nut D6M marketed by Williams Form Engineering Corp. of Grand Rapids, Mich.

With reference to FIGS. 11 and 12, an upper clamp plate 200 is also mountable to the shaft 172 of the J-bolt in place of securement plate 190. Clamp plate 200 has a downturned tang 202 and an opposing angled wing 204 which has an aperture 206. A guide sleeve 208 is welded to a central planar portion to provide a guideway for the J-bolt shank 172.

As illustrated in FIG. 12, the upper clamp plate 200 is dimensioned and configured for engaging the upper portion of a beam 19 such as, for example, may be a component of a roof truss. The J-bolt assembly is clamped to the beam 19 by the cooperative engagement J-bolt plate 174 and the upper clamp 200. The illustrated mounting configuration may be employed to obtain a tie-off point through aperture 206 before the roof sheathing is installed. Thus the anchor bolt assembly is capable of providing a tie-off to ensure worker safety during the initial roof construction stages. After the roof sheathing is installed, the upper clamp plate 200 is removed and securement plate 190 and wing nut 180 are mounted to the J-bolt in a loose assemblage. Alternately, the entire J-bolt/clamp plate assembly may be dismounted. After a pair of the J-bolt assemblies such as, for example, assembly 170 illustrated in FIG. 8, are loosely installed, the lifeline bracket assembly 102 is traversely moved so that the J-bolts pass through access slots 129 and the shank eventually projects through the slots 128. The wing nuts 180 are then securely locked to anchor the lifeline bracket assembly to the roof.

Figure 13:
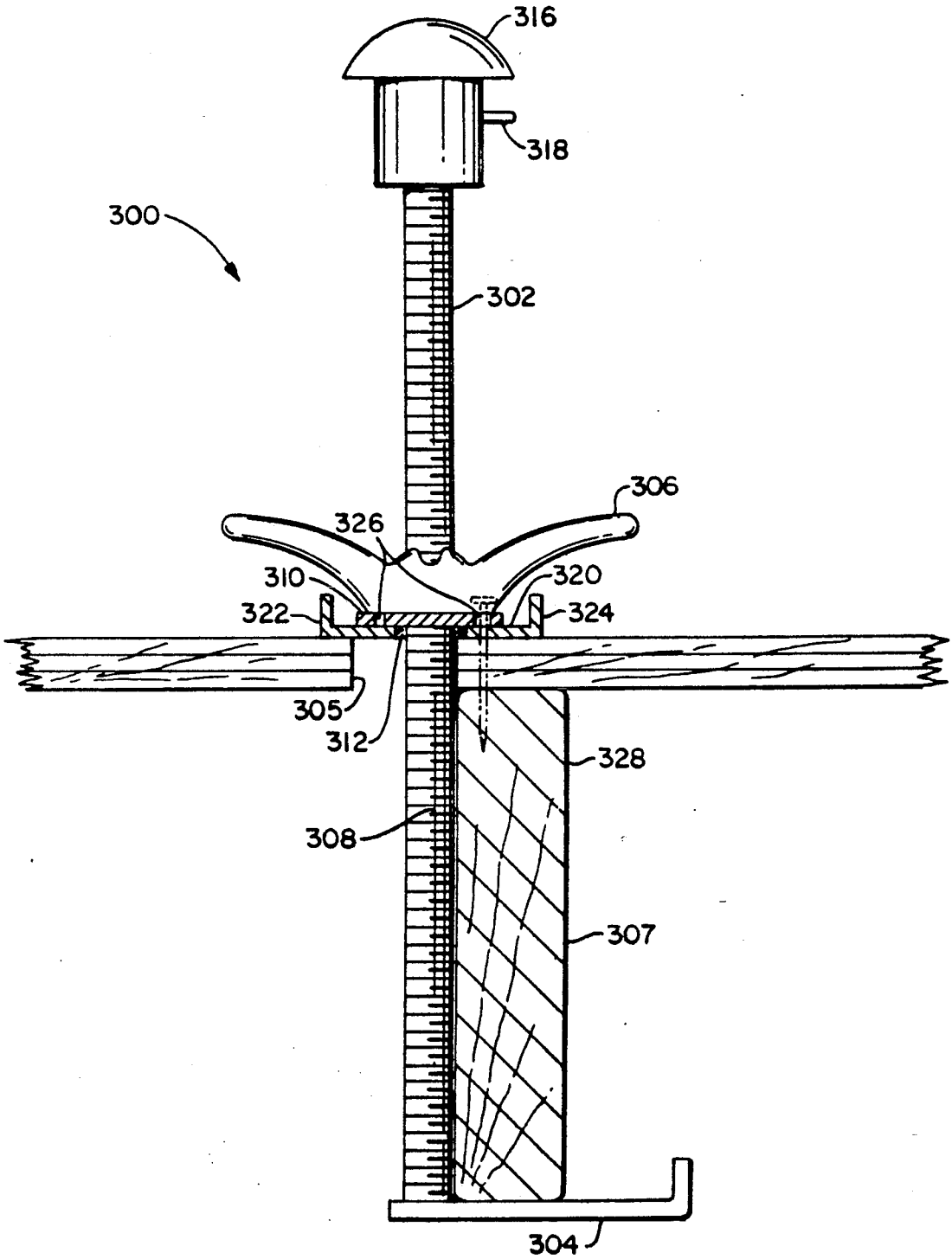
FIG. 13 is a side elevational view of a fourth embodiment of an anchor assembly and associated plate, said assembly and plate being mounted to a beam and roof illustrated in section.

With reference to FIG. 13, anchor assembly 300 comprises a J-bolt 302 having a lower foot or hook 304 which is dimensioned to transversely extend the thickness of two wood beams or rafters. An opening 305 (typically 1¼ inch) is drilled in the roof adjacent rafter 307. The J-bolt is secured by a weighted wing nut 306 threaded to the shank 308. The weighted wing nut torques against a washer 310 having an inner collar 312 which is seated in the opening of the anchor plate 314. Washer 310 may also be employed with plates 116 and 126 with the collar 312 essentially locating the washer in the slots 128. The weighted wing nut is resistent to loosening due to vibratory forces.

A plastic rebar cap 316 is mounted to the top of the shank of J-bolt. A locator pin 318 is secured to the shank and extends through an opening in the side of the rebar cap at substantially a right angle to the shank. The pin 318 is oriented to angularly align with the transversely projecting foot 304 so that during installation, when the foot is not readily visible, the installer will know the angular position of the foot. It will likewise be appreciated that the wing nut 306 and the washer 310 are essentially captured on the shank of the J-bolt.

The anchor plate 320 includes a pair of upturned reinforcement flanges 322 and 324 and a pair of opposing nail holes 326. A nail 328 may be driven through a hole 326 into the wooden rafter 307 for fixing the position of the anchor plate 320 on the roof as best illustrated in FIG. 13.

Figure 14:
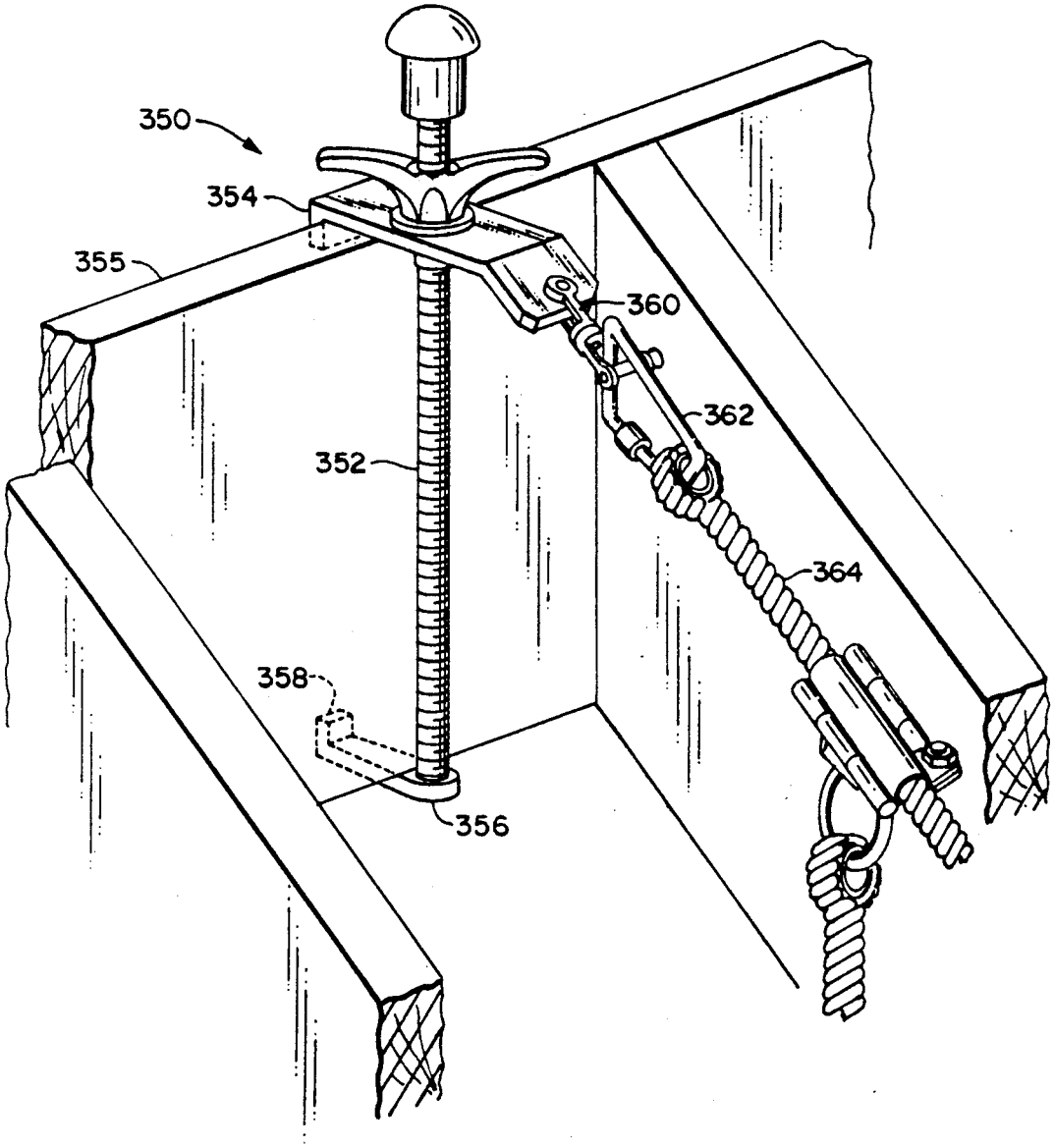
FIG. 14 is a perspective view of the anchor of FIG. 13 illustrated in conjunction with a second embodiment of the clamp plate of FIG. 11 and further illustrating an application of the anchor and plate assembly.

With reference to FIG. 14, anchor bolt assembly 350 comprises a J-bolt 352 and an anchor plate 354 which are secured to a rafter assembly or a roof beam frame 355, such as may be in place prior to installation of the roof. The J-bolt includes a foot 356 which is formed from an elongated strip of steel. Medial portions of the strip are bent around the lower portion of the shank and welded in place. The opposed ends of the strip have a greater width to form the hook tang. The foot has a tapered distal end 358 which converges in a V-shaped configuration which is also welded.

A swivel connector 360 may be bolted to the anchor plate through an aperture of the anchor plate and connected with a carabiner 362 for anchoring a safety rope 364.

Figure 15:
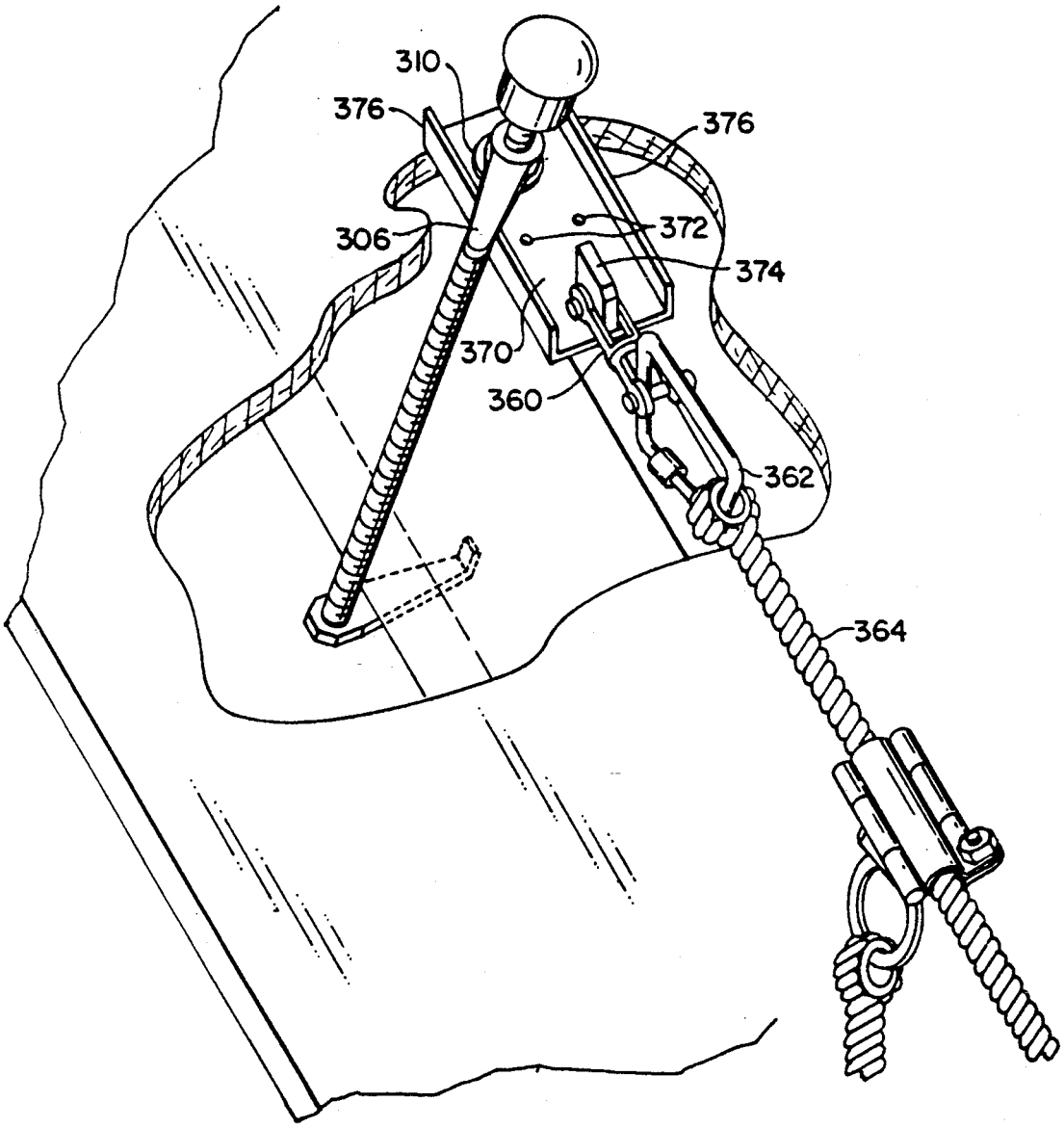
FIG. 15 is a perspective view of a fifth embodiment of the anchor assembly.

With reference to FIG. 15, a clamp plate 370 includes a pair of nail holes 372 and an upward projecting lug 374 which is disposed between reinforcement flanges 376. The lug has a through bore for mounting a swivel connector 360 for anchoring a safety rope 364 via carabiner 362. The clamp plate 370 also includes an enlarged opening for seating the collar 312 (not visible in FIG. 15) of the washer 310 which is torqued against the plate by the weighted wing nut 306.

Figure 16:
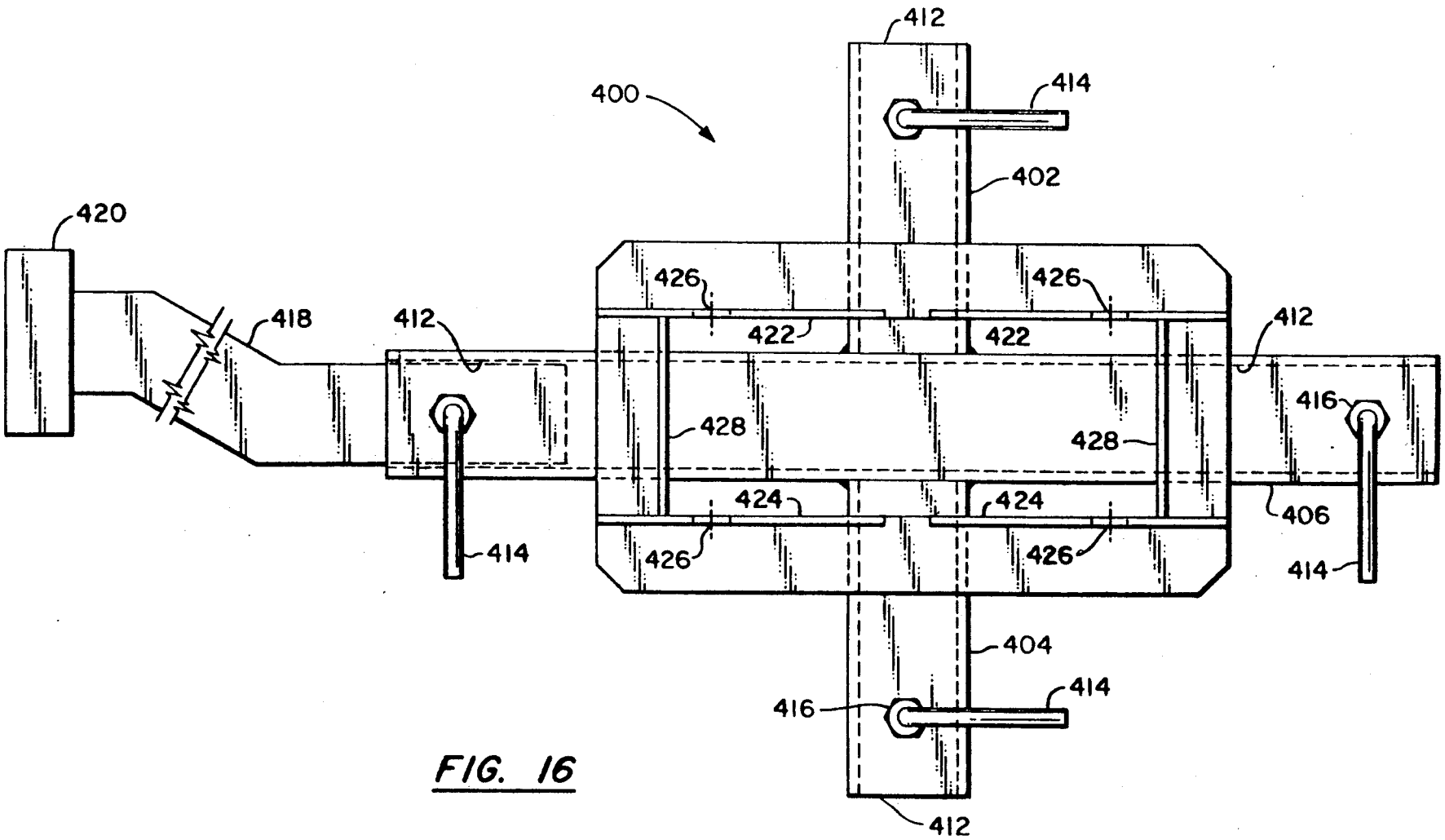
FIG. 16 is a top plan view, partly in phantom, partly in section and partly broken away, illustrating a base for a flat roof embodiment of a roof lifeline safety system together with a cantilever arm/counter weight unit.
Figure 17:
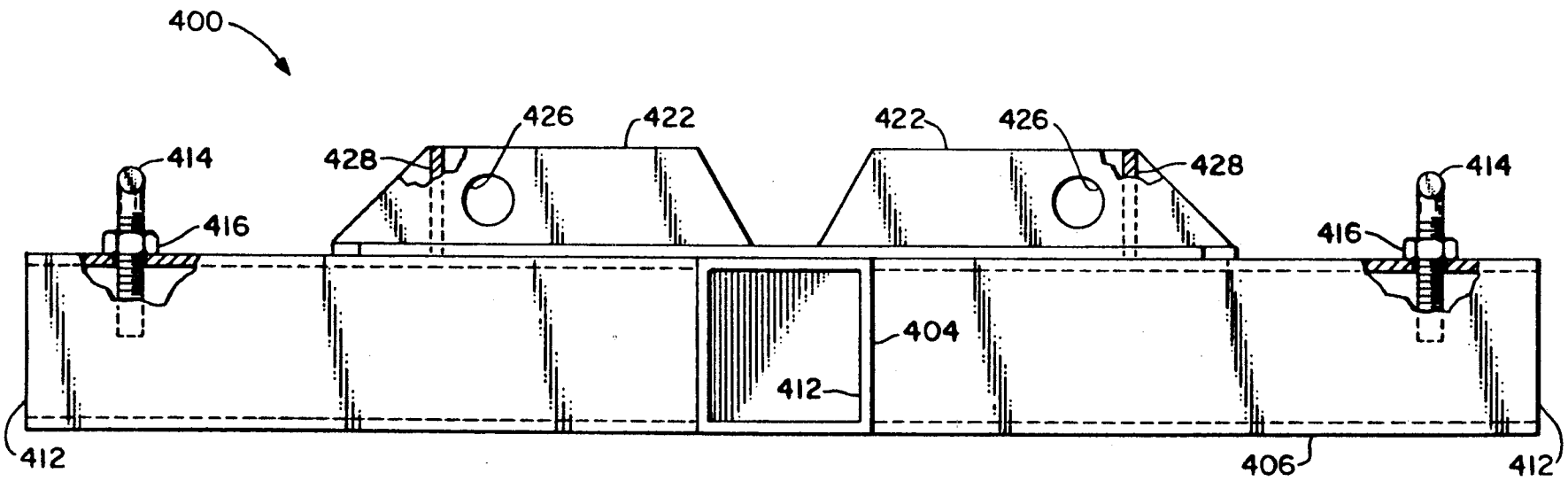
FIG. 17 is a side elevational view, partly in phantom, partly in section and partly broken away, of the base of FIG. 16.

With reference to FIGS. 16 and 17, a base for anchoring a roof lifeline safety system is designated generally by the numeral 400. Base 400 is especially suited for flat roofs and/or roofs where directly securing the lifeline safety shoe 104 to the roof such as by anchor bolts is problemmatic. Two identical square tubes 402 and 404 are welded at right angles to the medial portions of a longer tube 406. A plate is welded to the tops of the tubes to form a platform 410. The tube ends form four square sockets 412 which are disposed in perpendicular relationship and extend outwardly from the underside of the platform 410. L-shaped locking handles 414 are threaded through lock nuts 416 into the sockets 412 for frictionally securing the ends of cantilever arms 418 received in the sockets 412 (only a single arm being schematically illustrated in FIG. 16). The cantilever arms 418 may assume a wide variety of shapes. The outer ends of the arms are anchored by a weight 420. The weights 420 which bear against the outer ends of the cantilever arms function to immobilize the base on a flat roof. The weights 420 may be blocks of concrete or numerous other suitable forms having a high mass per unit volume.

Opposed pairs of flanges 422 and 424 extend upwardly from the platform for closely receiving the shoe 104. The flanges include opposed, aligned apertures 426 which receive pins (not illustrated) for securing the shoe to the platform. The ends of the shoe also engage against angle irons 428 to enhance the seated securement of the shoe to the platform. A retractable lifeline assembly 50 is then secured to the shoe 104 in the manner previously described.

It should be appreciated that the foregoing lifeline safety systems and the anchor assemblies provide efficient structures for mounting a safety lifeline to a pitched roof and other elevated structures. The lifeline safety system is easily installed and provides a mounting assembly having a high degree of structural integrity. In addition, the bracket frame assembly 102 may be relatively easily transformed to a portable configuration for transporting the bracket assembly to and from the job site. The various anchor assemblies also are adaptable to provide anchor points for a wide variety of applications.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety system for a pitched roof comprising:

lifeline means comprising a housing, a lifeline receivable by said housing and extendable and retractable relative thereto;

bracket means for mounting said lifeline means for disposition above the roof at the peak thereof comprising frame means for receiving said lifeline means and pod means pivotally mounted to said frame means, said pod means comprising a pair of legs and a mounting plate connecting said legs and extending at an oblique angle thereto to define shoulder means for engagement against said roof on opposing pitched sides thereof;

securement means for securing said lifeline means to said frame means; and anchoring means for anchoring said shoulder means to said roof.

2. The safety system of claim 1 wherein said frame means comprises a shoe having four panels forming an enclosure defining a generally rectangular upper opening, said frame closely receiving said lifeline means.

3. The safety system of claim 1 wherein said shoulder means comprises a pair of plates which are positionable at a variable angle to each other, each said plate engageable against opposed pitched portions of said roof in substantially surface-to-surface relationship.

4. The safety system of claim 1 wherein said securement means comprises a pin, said frame means further comprise a pair of spaced panels and means defining aligned openings through said spaced panels, and said housing defines an aperture, said pin being insertable through said panel openings and said aperture.

5. The safety system of claim 1 wherein said shoulder means further defines an opening and said anchoring means comprises a generally J-shaped bolt comprising a hook and a threaded shank, and a nut threadably engageable to said shank and torqueable for locking said shoulder means to said bolt.

6. The safety system of claim 5 wherein said shoulder means comprises a pair of plates and each said plate defines a slot, and said anchoring means comprises a pair of substantially identical generally J-shaped bolts.

7. The safety system of claim 6 wherein said slot has an oblong shape and a restricted portion opening through an edge of said plate.

8. The safety system of claim 1 wherein said frame means comprises a pair of spaced panels and said leg pairs are pivotally mounted to said panels at opposing locations thereof.

9. The anchoring system of claim 1 wherein said leg pairs are each mounted to said frame means by a pin and said plates are relatively positionable at a variable angle.

10. An anchor assembly comprising:

a quasi-J-shaped member comprising a hook portion and an elongated shank having a threaded surface, said hook portion comprising a tapered plate connected to said shank and having an upturned tang at a narrow portion of said tapered plate;

a plate mountable to said member, said plate defining an aperture dimensioned to receive said shank and an anchoring loop mounted to said plate; and a nut threadably engageable with said threaded surface for threadable longitudinal displacement therealong, said nut comprising a pair of opposing wing arms.

11. The anchor assembly of claim 10 wherein said plate further comprises a pair of spaced side flanges.

12. The anchor assembly of claim 11 wherein said loop is a generally inverted U-shaped member disposed between said side flanges.

13. An anchor assembly for securing a member having an opening therethrough to a substrate disposed above a support comprising:

a quasi-J-shaped member comprising a hook portion and an elongated shank having a threaded surface, said hook portion being dimensioned to be generally commensurate with the width of said support, and having a planar portion which tapers from an enlarged portion adjacent said shank to a narrow portion from which a tang extends generally perpendicularly, said tang being dimensioned for insertion through said opening and said shank being greater than the combined thickness of said substrate and the height of said support, so that said hook portion may engage the underside of said support and said shank projects upwardly through an opening of the substrate wherein said threaded surface extends at least partially generally above said substrate; and a nut threadably engageable with said threaded surface and disposed generally above said substrate, said nut having opposing transversely extending arms adapted for torquing said nut for clamping said member against said substrate.

14. The anchor system of claim 13 further comprising plate defining an aperture dimensioned to receive said shank, said plate being mounted to said shank and disposed between said member and said nut, an anchoring loop projecting from said anchoring plate.

15. The anchor assembly of claim 13 further comprising a clamp plate mountable to said shank, said clamp plate comprising a tang, an opposing wing portion defining an aperture and a guide sleeve disposed between said tang and aperture and dimensioned to receive said shank.

16. The anchor system of claim 13 further comprising an anchor plate defining an aperture dimensioned to receive said shank, said plate being mounted to said shank and disposed between said member and said nut, an anchoring loop projecting from said anchoring plate.

17. A safety system for mounting a lifeline to a pitched roof wherein said lifeline comprises a housing, and a cable receivable by said housing and extendable and retractable relative thereto, said system comprising:

bracket means for mounting said lifeline means for disposition above the roof at the peak thereof comprising shoe means for receiving said lifeline means and pod means pivotally mounted to said shoe means, said pod means defining a pair of shoulder plates for engagement against said roof on opposing pitched sides thereof at a variety of pitch angles, said shoulder plates each defining a carrier slot, said plates being pivotal to a first pivotal position wherein said slots generally align in adjacent relationship; and securement means for securing said lifeline to said shoe means.

18. A safety system for a roof comprising:

lifeline means comprising a housing, a lifeline receivable by said housing and extendable and retractable relative thereto;

base means comprising a platform and four socket means extending therefrom, said socket means each adapted to receive an arm and lock means for locking said arm to said socket means;

shoe means for receiving said lifeline means;

frame means projecting from said platform and spaced to receive opposing sides of said shoe means; and securement means for securing said shoe means to said frame means.

19. The safety system of claim 18 wherein said sockets are substantially square and said sockets are oriented in mutually perpendicular relationship.

20. The safety system of claim 18 wherein said frame means comprises two pairs of projecting sides which closely receive said shoe means, one said pair defining spaced pairs of opposed aligned apertures.

21. The safety system of claim 18 wherein said lock means comprises a L-shaped handle threaded to said socket means.

22. An anchor assembly comprising:

a quasi-J-shaped member comprising a threaded shank having first and second ends and a hook portion projecting at a generally right angle to said shank at said first end;

a cap mounted to said second end; and an indicator projecting from said shank proximate said second end said indicator generally angularly aligning with said hook portion.

23. The anchor assembly of claim 22 further comprising a weighted wing nut threaded to said shank.

24. The anchor assembly of claim 22 further comprising a washer having a projecting collar mounted to said shank.

25. The anchor of assembly of claim 24 further comprising a clamp plate, said plate defining an opening dimensioned to receive said collar and seat said washer.

26. The anchor assembly of claim 25 wherein said plate further connects with a swivel connector 27. The anchor assembly of claim 25 further comprising a lug projecting from said plate, said lug defining a bore, a bolt disposed in said bore for connecting with said swivel connection.

28. The anchor assembly of claim 22 wherein said hook portion further comprises a metal strip having opposing ends and a medial portion, said strip being bent around said shank at medial strip portion, said strip converging at said end portions thereof.

29. The anchor assembly of claim 25 wherein said plate further defines at least one opening dimensioned to receive a nail.

30. A safety system for a pitched roof comprising:

lifeline means comprising a housing, a lifeline receivable by said housing and extendable and retractable relative thereto, said housing defining an outlet, and support bracket means mounted to said housing proximate the housing outlet for mounting a coil spring, said lifeline traversely through said spring.

bracket means for mounting said lifeline means for disposition above the roof at the peak thereof comprising frame means for receiving said lifeline means and pod means pivotally mounted to said frame means, said pod means defining shoulder means for engagement against said roof on opposing pitched sides thereof;

securement means for securing said lifeline means to said frame means; and anchoring means for anchoring said shoulder means to said roof.

31. The safety system of claim 30 further comprising a plug defining a bore, said plug disposed interiorly of said spring and said lifeline traversing said bore.

32. A safety system for a pitched roof comprising:

lifeline means comprising a housing, a lifeline receivable by said housing and extendable and retractable relative thereto;

bracket means for mounting said lifeline means for disposition above the roof at the peak thereof comprising frame means for receiving said lifeline means and pod means pivotally mounted to said frame means, said pod means defining shoulder means for engagement against said roof on opposed pitched sides thereof, said shoulder means further comprising a pair of plates and each plate defining a carrying slot, said plates being pivotal so that said plates mutually engage in surface-to-surface relationship and said slots generally align;

securement means for securing said lifeline means to said frame means; and anchoring means for anchoring said shoulder means to said roof.

33. An anchor assembly comprising:

a quasi-J-shaped member comprising a hook portion and an elongated shank having a threaded surface;

a plate mountable to said member, said plate defining an aperture dimensioned to receive said shank and an anchoring loop mounted to said plate;

a nut threadably engageable with said threaded surface for threadable longitudinal displacement therealong, said nut comprising a pair of opposing wing arms; and a clamp plate mountable to said shank, said clamp plate comprising a tang, an opposing wing portion defining an aperture and a guide sleeve disposed between said tang and aperture and dimensioned to receive said shank.

* * * * *